United States Patent [19]

Brock et al.

[11] 4,147,567

[45] Apr. 3, 1979

[54] PHOSPHATING PROCESS

[75] Inventors: Michael Brock, Reading; Brian A. Cooke, Knotty Green, both of England

[73] Assignee: Imperial Chemical Industries Limited, London, England

[21] Appl. No.: 853,814

[22] Filed: Nov. 21, 1977

[30] Foreign Application Priority Data

Nov. 24, 1976 [GB] United Kingdom ..... 48957/76

[51] Int. Cl.[2] ..... C23F 7/10; C23F 7/12; C23F 7/14

[52] U.S. Cl. ..... 148/6.15 Z; 148/6.15 R

[58] Field of Search ..... 148/6.17, 6.15 Z, 6.15 R; 252/136, 151, 554, 180, 181, 82, 87; 106/123 R, 123 LC

[56] References Cited

U.S. PATENT DOCUMENTS

| | | | |
|---|---|---|---|
| 2,505,457 | 4/1950 | Bird | 252/180 X |
| 2,724,668 | 11/1955 | Russell | 148/6.15 R |
| 2,826,552 | 3/1958 | Bonewitz et al. | 252/180 X |
| 3,085,975 | 4/1963 | Jennings | 252/181 X |
| 3,751,372 | 8/1973 | Zecher | 252/181 |
| 3,870,573 | 3/1975 | Smith | 148/6.15 Z |

FOREIGN PATENT DOCUMENTS

| | | | |
|---|---|---|---|
| 932845 | 7/1963 | United Kingdom | 148/6.15 Z |

OTHER PUBLICATIONS

Kejha, Chem. Abs. vol. 62: 13390b (1965).

*Primary Examiner*—Ralph S. Kendall
*Attorney, Agent, or Firm*—Cushman, Darby & Cushman

[57] ABSTRACT

Water-soluble lignosulphonate salts when present in an acid metal phosphating solution modify the physical form of sludge produced therein when the solution is used to treat a metal substrate. Process efficiency is improved.

3 Claims, No Drawings

PHOSPHATING PROCESS

This invention relates to a process of applying a phosphate coating to metal substrates, more particularly to the alleviation of the harmful effect of sludge formation in such a process. The invention also relates to new phosphating solutions.

Phosphate coatings may be applied to metal substrates, notably ferrous substrates, by reaction of the substrate with an aqueous acidic solution of certain metal phosphates, e.g. phosphates of iron, manganese and zinc. There are certain by-products of the reaction with the substrate some of which are precipitated from the phosphating solution as coating proceeds. These by-products will usually include an insoluble phosphate salt of the substrate metal, for example ferric phosphate in the case of a ferrous substrate.

The precipitate is a hindrance to efficient coating since it may form a crust on the walls of the coating bath and its associated equipment, in particular any heat-transfer surfaces. Also, the precipitate accumulates as a layer of sludge in the bottom of the coating bath or in any reservoir for the working coating solution and this sludge may be difficult to remove when its removal is desirable. A further possibility is that the phosphated work pieces may become contaminated. The formation of an insulating crust on the heat transfer surfaces located in the coating bath and, in the case of a spray process, on the spray nozzles, necessitates frequent scraping of these and other parts of the equipment in order to maintain the efficiency of the process; for example good heat transfer and temperature control.

We have now found that the precipitate which is produced in phosphating processes of the type described above can be modified in its physical form by the addition to the bath of certain water soluble materials, so that the precipitate is less likely to cake into a rigid mass and it has a reduced tendency to form a crust on, for example, heat transfer surfaces and spray nozzles.

According to this invention we provide an improved process of applying a phosphate coating to a metal substrate by treating the substrate with an acidic metal phosphate solution in the presence of a water-soluble lignosulphonate. By a water-soluble lignosulphonate we mean a lignosulphonate which is soluble in the aqueous coating solution. It may be added in any suitable form, for example as a sodium, potassium, ammonium or other metal salt. One particularly convenient material is that comprising soduim lignosulphonate which is a by-product in the manufacture of paper. A suitable material is that commercially available as Wanin S (Steetley Chemicals).

We have found that the use of a lignosulphonate in this invention is responsible for a very significant decrease in the formation of crust on heating pipes and the like and/or that any crust which is formed can be more readily removed. There is, therefore, a valuable saving in maintenance costs and the efficiency of the process is improved.

Preferably the phosphating solution contains at least 1 part per million (ppm) of the water-soluble lignosulphonate and preferably at least 5 ppm. A suitable concentration is in the region of 50 ppm. This may be increased, for example to 100 ppm, but higher concentrations do not usually confer significant advantage. The lignosulphonate may be added separately to the phosphating solution or it may be added in admixture with the replenishment as coating proceeds.

The present process is applicable to all conventional phosphating processes, for example to spray and dip processes. Preferably it is applied to ferrous substrates, but may be applied to zinc, aluminium or mixed metal surfaces.

This invention also provides a phosphating solution comprising a water-soluble lignosulphonate as herein described for use in conventional phosphating processes. This solution may comprise any of the conventional ingredients of phosphating baths such as, for example, depolarising oxidants. The invention is particularly applicable to phosphating solutions which comprise acidic zinc phosphate.

The invention is illustrated by the following Example in which parts and percentages are by weight:

EXAMPLE

The heat transfer conditions existing in an industrial phosphating bath were simulated in the laboratory by the following procedure:

4 liters of an aqueous phosphating solution were prepared which contained 1.24% Zn, 1.0% $PO_4$, and 2.4% $NO_3$, and which had a total acid pointage of 38 points (Number of mis. N 10 NaOH required to nitrate a 10 ml. sample of the solution using phenolphthalein as indicator). The phosphating solution was stirred slowly to maintain its homogeneity and its temperature maintained at 71° C. by a tubular mild steel heating jacket containing a silicone oil which was heated to about 160° C. by an electrically heated element. This silicone oil was stirred rapidly to ensure an even temperature over the exterior of the heating jacket.

An initial small addition of sodium nitrite toner was made to the solution (to provide a titre of 2 ml. N/10 $KMnO_4$ against 50 ml. of the solution in the presence of 50% $H_2SO_4$). A mild steel panel was passed through the phosphating solution every 15 minutes, the total time of immersion of each panel being 5 minutes. The solution was regularly replenished with a concentrate containing 11.8% Zn, 34.5% $PO_4$ and 13.9% $NO_3$ to maintain a pointage of 38-42 and after a total of 126 panels had been treated in the solution the zinc content of the solution had been replaced twice.

In parallel experiments using the above procedure:

(a) in which the solution contained no other additive:

(b) in which the solution contained 50 ppm of a lignosulphonate commercially available as "Wanin S" from Steetley Chemicals. "Wanin S" comprises a mixture of 60% sodium lignosulphonate, 26% sugars and other impurities; the following observations were made:

(a) the heating jacket was coated with an adherent crust about 1/8" thick and the sludge (when removed by decantation and placed in a measuring cylinder to a sludge height of 20 cm.) was very fine and was virtually impenetrateable by a glass rod;

(b) the heating jacket had a thin loose crust which was readily dislodged and the sludge (tested as above) was relatively mobile and could be easily penetrated by the glass rod.

We claim:

1. A process of applying a phosphate coating to a metal substrate comprising iron, zinc or aluminum by treating the substrate with an acidic zinc phosphate solution which contains 1 to 100 parts per million parts of solution of a water-soluble sodium, potassium or ammonium salt of a lignosulphonate.

2. A process according to claim 1 wherein the metal substrate is treated by spraying with or by immersion in the acid metal phosphate solution.

3. An acidic metal phosphate solution comprising a depolarising oxidant and 1 to 100 parts of a water-soluble lignosulphonate per million parts of the solution.

* * * * *